US012746593B2

(12) United States Patent
Kulakov et al.

(10) Patent No.: US 12,746,593 B2
(45) Date of Patent: Sep. 29, 2026

(54) RADIAL FORGING FOR THE MANUFACTURE OF BALL SCREW ACTUATOR SHAFTS

(71) Applicant: THE BOEING COMPANY, Arlington, VA (US)

(72) Inventors: Mykola Kulakov, East Dunbartonshire (GB); David Milliken, Sheffield (GB)

(73) Assignee: The Boeing Company, Arlington, VA (US)

( * ) Notice: Subject to any disclaimer, the term of this patent is extended or adjusted under 35 U.S.C. 154(b) by 222 days.

(21) Appl. No.: 18/406,004

(22) Filed: Jan. 5, 2024

(65) Prior Publication Data

US 2024/0300005 A1 Sep. 12, 2024

Related U.S. Application Data

(60) Provisional application No. 63/489,679, filed on Mar. 10, 2023.

(51) Int. Cl.
*B21J 5/00* (2006.01)

(52) U.S. Cl.
CPC ..... *B21J 5/008* (2013.01)

(58) Field of Classification Search
CPC ..... B21J 7/02; B21J 7/14; B21J 5/008; B21J 9/02; B21J 9/022; B21C 3/16; B21C 3/02; B21C 37/15; B21C 37/16
See application file for complete search history.

(56) References Cited

U.S. PATENT DOCUMENTS 4,722,216 A 2/1988 Fencl
7,412,866 B2 * 8/2008 Jahani ..... B21C 37/16 72/370.14
8,166,792 B2 5/2012 Prasser et al.
9,409,226 B2 8/2016 Koppensteiner
9,662,696 B2 5/2017 Pichler
9,982,706 B2 * 5/2018 Jo ..... B21J 7/14
10,940,523 B2 3/2021 Heck et al.
2010/0251794 A1 10/2010 Wiedenmaier et al.
2013/0025338 A1 1/2013 Vohskaemper et al.
2022/0134401 A1 * 5/2022 Steinmetz ..... B21C 37/16 72/370.04

OTHER PUBLICATIONS

Jianglin Huang et al., "A Dynamic Model for Simulation of Hot Radial Forging Process," Elsevier, ScienceDirect, Procedia Engineering 207 (2017) 478-483.

* cited by examiner

*Primary Examiner* — Teresa M Ekiert
(74) *Attorney, Agent, or Firm* — Walters & Wasylyna LLC

(57) ABSTRACT

Methods are presented for the manufacture of tubular components having complex geometries. An exemplary method includes performing three radial forging operations on a workpiece that includes a bore along a longitudinal axis extending from a first end to a second end opposite the first end. The first radial forging operation includes holding the workpiece at the second end, and radially forging at least a portion of a first region proximal to the first end of the workpiece. The second radial forging operation includes holding the workpiece at the first end, and radially forging at least a first portion of a second region of the workpiece, the second region extending from the second end to a third region adjoining the first region. The third radial forging operation includes holding the workpiece at the first end, and radially forging at least a second portion of the second region of the workpiece.

20 Claims, 7 Drawing Sheets

RADIAL FORGING FOR THE MANUFACTURE OF BALL SCREW ACTUATOR SHAFTS

CROSS-REFERENCE TO RELATED APPLICATIONS

This application claims benefit of U.S. Provisional patent application Ser. No. 63/489,679, filed Mar. 10, 2023, which is incorporated herein by reference in its entirety.

FIELD

Aspects of the present disclosure relate to the manufacture of tubular components having complex geometries. In particular, aspects concern the use of radial forging as at least a part of a manufacturing process.

BACKGROUND

Tubular components having complex geometries are manufactured typically by machining the components out of round bar stock material. The complex geometries may include any one or more of variations in outer diameter and/or inner diameter; variations of wall thickness; or a component length greater than 20 times a minimum outer diameter combined with a wall thickness less than about 20% of a minimum outer diameter. While machining can produce such components within stringent tolerances, the manufacture of tubular components in this way can result in significant waste of material. Such a waste can lead to relatively high costs of components that are manufactured out of high grade specialist alloys that are used in industries such as aerospace. There is a need to manufacture tubular components having complex geometries without incurring such a significant waste of material.

SUMMARY

The present disclosure relates to the manufacture of tubular components. In particular, aspects of the present disclosure are directed to the manufacture of tubular components having complex geometries. In one aspect, a method of manufacturing a tubular component includes performing a first radial forging operation on a workpiece, the workpiece including a bore along a longitudinal axis extending from a first end to a second end opposite the first end. The first radial forging operation includes: holding the workpiece at the second end; and radially forging at least a portion of a first region proximal to the first end of the workpiece from a first outer diameter to a smaller second outer diameter. The method further includes performing a second radial forging operation on the workpiece that includes: holding the workpiece at the first end; and radially forging at least a first portion of a second region of the workpiece from the first outer diameter to a smaller third outer diameter, the second region extending from the second end to a third region adjoining the first region. The method further includes performing a third radial forging operation on the workpiece that includes: holding the workpiece at the first end; and radially forging at least a second portion of the second region of the workpiece from the third outer diameter to a smaller fourth outer diameter.

In another aspect, a method involves performing a radial forging operation on a workpiece. The workpiece includes a bore along a longitudinal axis extending from a first end to a second end opposite the first end. The radial forging operation includes: holding the workpiece at the first end with a clamp; using the clamp to position the workpiece between hammers of a radial forging machine; inserting a mandrel into the bore of the workpiece at the second end, and positioning a portion of the mandrel within the bore between the hammers; using the clamp to pull the workpiece in a first direction between the hammers while the hammers radially forge a portion of the workpiece; and moving the mandrel axially with respect to the hammers while the hammers radially forge the portion of the workpiece.

In another aspect, a method involves performing a radial forging operation on a workpiece. The workpiece includes a bore along a longitudinal axis extending from a first end to a second end opposite the first end. The radial forging operation includes: holding the workpiece at the first end with a clamp; using the clamp to position the workpiece between hammers of a radial forging machine; performing a first pass forging operation by using the clamp to pull the workpiece in a first direction between the hammers while operating the hammers to radially forge a portion of the workpiece including the second end; then ceasing the operating of the hammers. The method further includes without removing the workpiece from the radial forging machine, using the clamp to push the workpiece in a second direction opposite to the first direction between the hammers to position a section of the workpiece between the hammers, the section proximal to the portion of the workpiece; restarting the operating of the hammers; and performing a second pass forging operation by using the clamp to pull the workpiece in the first direction between the hammers while operating the hammers to radially forge the portion of the workpiece including the second end.

BRIEF DESCRIPTION OF THE DRAWINGS

So that the manner in which the above recited features can be understood in detail, a more particular description, briefly summarized above, may be had by reference to example aspects, some of which are illustrated in the appended drawings.

To facilitate understanding, identical reference numerals have been used, where possible, to designate identical elements that are common to the figures. It is contemplated that elements and features of any one aspect may be beneficially incorporated in other aspects without further recitation.

DETAILED DESCRIPTION

The present disclosure relates to the manufacture of tubular components. In particular, aspects of the present disclosure are directed to the manufacture of tubular components having complex geometries. In an example, a tubular component may have several changes of inner and/or outer diameter along a length of the component, including a maximum outer diameter approximately double, or greater than double, a minimum outer diameter. Additionally, a tubular component may have a length that is 15 to 35 times the minimum outside diameter. A further example tubular component may have a length greater than 15 to 35 times a minimum outer diameter combined with a wall thickness less than about 20% of a minimum outer diameter. An exemplary tubular component may include any one or more of the foregoing features. Examples of such tubular components include actuators, such as ballscrew actuator shafts, for aircraft control surfaces.

Figure 1A:
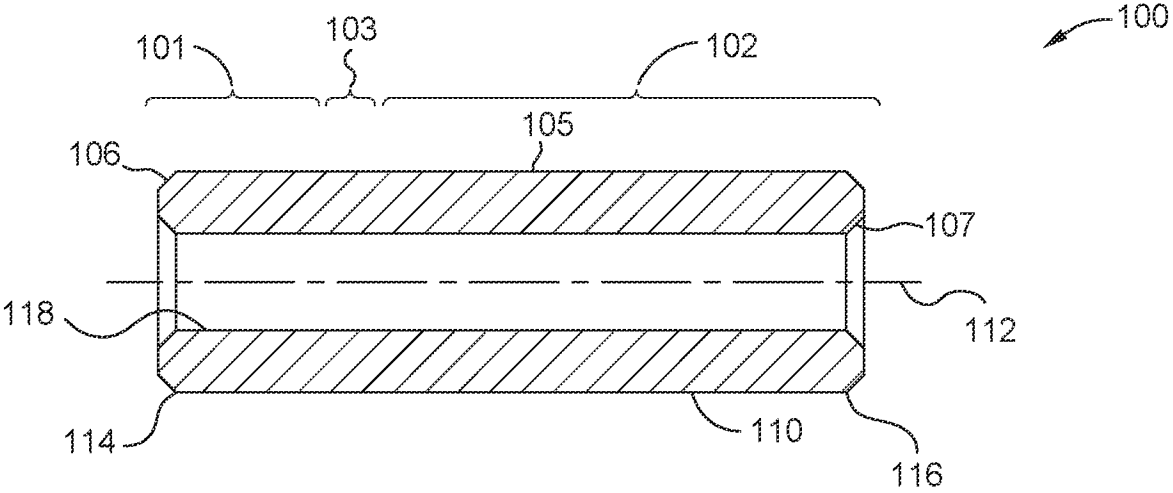
FIGS. 1A-1C are longitudinal cross-sections that schematically illustrate an overview of the manufacture of a tubular component.
Figure 1B:
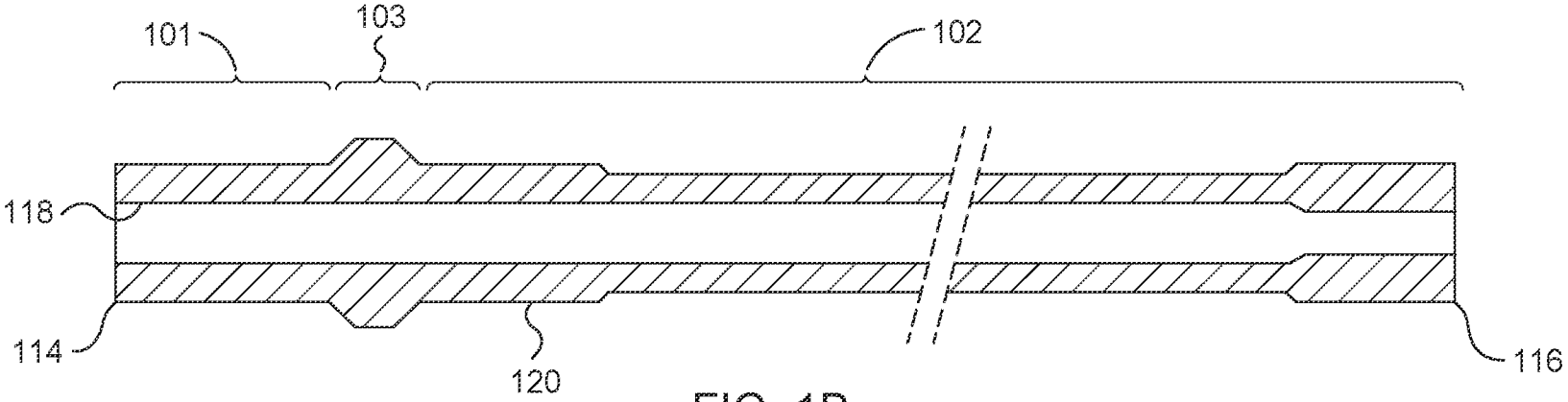
Figure 1C:
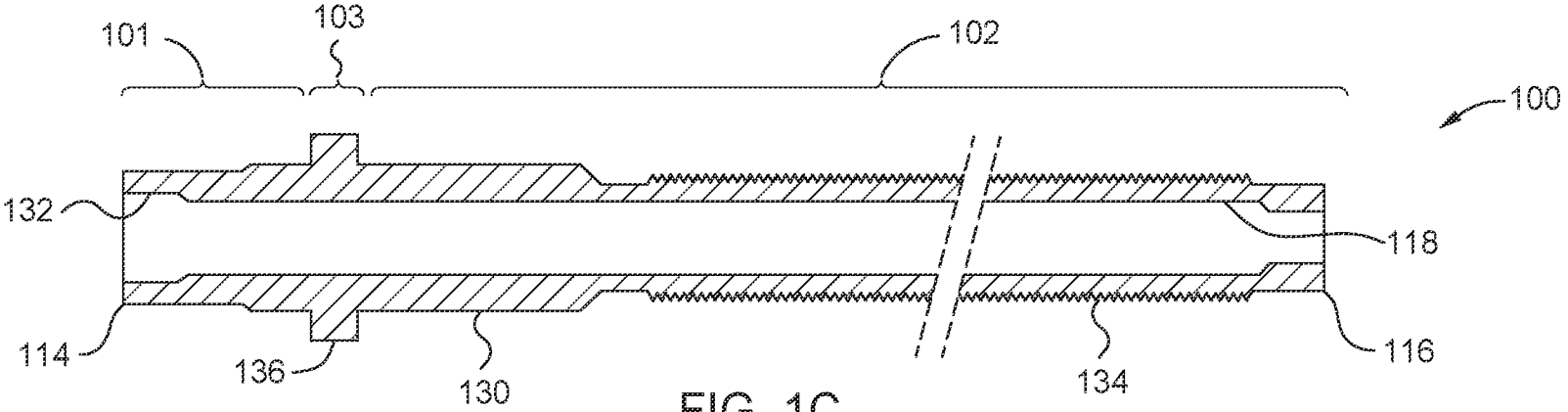

FIGS. 1A-1C are longitudinal cross-sections that schematically illustrate an overview of the manufacture of a tubular component. In FIG. 1A, a workpiece 100 is in the form of a "preform" 110 such as a tubular billet, and includes a bore 118 along a longitudinal axis 112 extending from a first end 114 to a second end 116 opposite the first end 114. The workpiece 100 includes a first region 101 proximal to the first end 114 and a second region 102 that extends from the second end 116 to a third region 103 adjoining the first region 101. In some aspects the workpiece includes chamfers at the ends 114, 116. As illustrated, the workpiece includes an external chamfer 106 where the outer surface 105 terminates at each end 114, 116, and includes an internal chamfer 107 where the bore 118 terminates at each end 114, 116. In some aspects, one or more of the chamfers 106, 107 may be omitted. The workpiece 100 is a metal, such as aluminum, an aluminum alloy, titanium, a titanium alloy, or a steel, such as a low alloy steel, a stainless steel or a tool steel. Examples of steel include 9310 (Aerospace Material Specification (AMS) 6265), Cronidur 30 (AMS 5898), and XD15NW (AMS 5925).

FIG. 1B schematically illustrates the workpiece 100 having undergone a radial forging process to produce an intermediate component 120. The radial forging operation to produce the intermediate component 120 is described below. The workpiece 100 is shown having been radially forged in the first region 101, the second region 102, and the third region 103. In some aspects, the workpiece 100 does not undergo radial forging of the third region 103 to produce the intermediate component 120.

FIG. 1C schematically illustrates a tubular finished component 130 after further processing the intermediate component 120. In some aspects, the intermediate component 120 is machined to produce the finished component 130. In some aspects, when the workpiece 100 is in the form of the preform 110 as shown in FIG. 1A, the outer diameter of the preform 110 is selected to be slightly larger than the maximum outer diameter of the finished component 130. In some aspects, the entire workpiece 100 is subjected to forging during the manufacture of the finished component 130 from the preform 110. In some aspects, only a portion of the entire workpiece 100 is subjected to forging during the manufacture of the finished component 130 from the preform 110. In some aspects, when the workpiece 100 is in the form of the intermediate component 120, the entire workpiece 100 is subjected to machining during the manufacture of the finished component 130. In some aspects, when the workpiece 100 is in the form of the intermediate component 120, only a portion of the entire workpiece 100 is subjected to machining during the manufacture of the finished component 130.

As illustrated in the Figure, an example finished component 130 is a ballscrew actuator shaft. The intermediate component 120 is machined in the first region 101 to form a connector 132 at the first end 114. The intermediate component 120 is machined in at least a portion of the second region 102 to form a ballscrew thread 134. The intermediate component 120 is machined at the interface of the first and third regions 101, 103 and at the interface of the second and third regions 102, 103 to form a flange 136. In some aspects, other features, such as a connector at the second end 116, may be formed. In some aspects, operations additional to, or alternative to, machining are performed on the intermediate component 120 to create the finished component 130. For example, one or more portions of the intermediate component 120 may undergo any one or more of heat treating, nitriding, carburizing, induction hardening, anodizing, electroplating, or any other operation to form the finished component 130.

Figure 2:
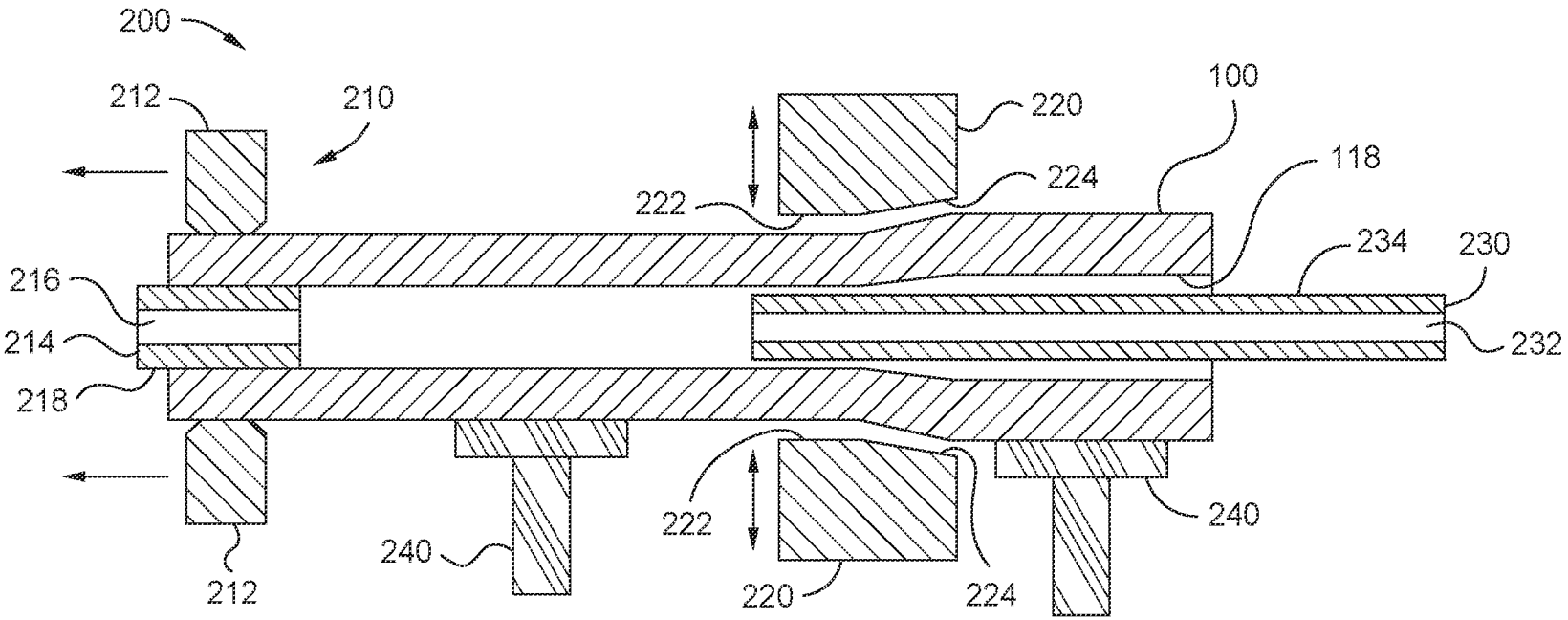
FIG. 2 schematically illustrates in longitudinal cross-section an overview of an exemplary radial forging operation.

FIG. 2 schematically illustrates in longitudinal cross-section an overview of an exemplary radial forging operation conducted using a radial forging machine 200 or so-called "forging box."

In some aspects, the radial forging operation includes heating the workpiece 100 just prior to forging in order to make the material of the workpiece 100 malleable. The heating is performed in an induction heater, a furnace, or the like. The workpiece may be heated from an initial ambient temperature (such as room temperature), or from an intermediate temperature between ambient temperature and a forging temperature, to a temperature deemed suitable for forging. In an example, the workpiece 100 is heated to a temperature from 750° C. to 1350° C., such as from 800° C. to 1300° C., from 900° C. to 1200° C., or from 1000° C. to 1100° C. Selection of the heating temperature can depend on any one or more factors, such as the metallurgy of the workpiece 100, the dimensions of the workpiece 100, the amount of diameter reduction to be accomplished by the forging, the length of the section of the workpiece 100 that is to be forged, the amount by which the workpiece 100 cools between heating and forging, or the amount by which the workpiece 100 cools during forging. In some aspects, the entire workpiece 100 is heated just prior to forging. In other aspects, a selected section of the workpiece 100 is heated just prior to forging. In such aspects, the selected section of the workpiece 100 is heated to a temperature as described above, whereas another section of the workpiece 100 becomes heated to a lesser temperature as a result of heat conduction through the workpiece 100.

The workpiece 100 is held at one end (in this example at the second end) by a clamp 210. The clamp 210 includes two or more jaws 212 that grip the workpiece 100. The clamp 210 moves the workpiece 100 longitudinally during the forging process. In some aspects, the clamp 210 rotates the workpiece 100 about the longitudinal axis 112 during the forging process. In an example, the clamp 210 rotates the workpiece 100 about the longitudinal axis 112 at a rate of 40 to 70 rpm during the forging process. In some aspects, the clamp 210 does not rotate the workpiece 100 about the longitudinal axis 112 during the forging process.

In some instances, the workpiece 100 may be at risk of deformation by the clamp 210. Exemplary situations include the section of the workpiece 100 being clamped having a relatively small wall thickness and/or being at a temperature at which the workpiece 100 material is relatively malleable. The deformation may manifest in the bore 118 through the workpiece 100, such as in a localized reduction of inner diameter or the bore 118 becoming out-of-round. In order to hinder deformation of the workpiece 100 by the clamp 210, the clamp 210 may include a clamping mandrel 214 that is inserted into the bore 118 of the workpiece 100, and is located between the jaws 212. In an example, the difference between the outer diameter of the clamping mandrel 214 and the minimum inner diameter of the workpiece 100 bore 118 at the section being clamped is in a range of from 0.2 mm to 1.5 mm (such as 0.5 mm, 0.7 mm, 0.9 mm, 1 mm, or 1.2 mm). In some aspects, the outer diameter of the clamping mandrel 214 includes a taper, such as 0.15 degrees or less, 0.01 degrees or less, or 0.05 degrees or less.

As illustrated, in some aspects, the clamping mandrel 214 includes a channel 216 through which a coolant, such as water or air (such as compressed air), is flowed. In some aspects, the channel 216 may be omitted. In some aspects, an exterior of the clamping mandrel 214 includes a coating 218, such as a ceramic. Exemplary coating 218 materials include metal carbides, such as tungsten carbide, and metal oxides, such as zirconium oxide or aluminum oxide. In some aspects, the coating 218 may include a metal carbide combined with a minor amount of another metal, such as cobalt or chromium In some aspects, the coating 218 resists adhering to the workpiece 100. In some aspects, such as aspects in which the coating 218 includes one or more ceramics such as zirconium oxide, the coating 218 has a thermal conductivity that is lower than a thermal conductivity of the material of the clamping mandrel 214. In an example, the coating 218 plus the coolant serve to hinder the temperature rise experienced by the clamping mandrel 214 resulting from insertion into the bore 118 of the workpiece 100. In such an example, the thermal expansion of the clamping mandrel 214 may be so managed to avoid the clamping mandrel 214 becoming stuck within the bore 118 of the workpiece 100. In some aspects, the coating 218 has a thermal conductivity that is higher than a thermal conductivity of the material of the clamping mandrel 214. In some aspects, the coating 218 prevents metal-to-metal contact between the base metal of the clamping mandrel 214 and the workpiece 100. In some aspects, the interface between the clamping mandrel 214 and the bore 118 of the workpiece 100 is lubricated, such as by graphite, to aid subsequent removal of the clamping mandrel 214 from the workpiece 100. In some aspects, the clamping mandrel 214 may be omitted.

Radial forging of the workpiece 100 is performed by two or more hammers 220. The hammers 220 are arranged circumferentially around the workpiece 100, and reciprocate in a direction perpendicular to the longitudinal axis 112 of the workpiece 100. In an exemplary arrangement, four hammers 220 are arranged circumferentially around the workpiece 100. Each hammer 220 includes a strike surface 222 that contacts the workpiece 100 during forging. The strike surface 222 includes a concave profile that is parallel to the longitudinal axis 112 of the workpiece 100. As illustrated, in some aspects, each hammer 220 includes also a tapered trailing surface 224. In some aspects, the tapered trailing surface 224 guides material of the workpiece 100 that is displaced along the workpiece 100 at each blow by the hammer 220. In some aspects, the tapered trailing surface 224 includes a concave profile that is parallel to the longitudinal axis 112 of the workpiece 100. In some of such aspects, the concave profile of the strike surface 222 is continuous with the concave profile of the tapered trailing surface 224. The hammers 220 are made from a metal, such as a steel, such as a tool steel, such as H13. In some aspects, the hammers 220 may be hardened, such as to 52-54 HRC.

A forging mandrel 230 is shown inserted into the bore 118 of the workpiece 100. The forging mandrel 230 is made from a metal, such as a steel, such as a tool steel, such as H13. The forging mandrel 230 is sized to be slightly less than the designed minimum inner diameter of the workpiece 100 resulting from the forging operation. In an example, the difference between the designed minimum inner diameter of the workpiece 100 resulting from the forging operation and the outer diameter of the forging mandrel 230 is in a range of from 2 mm to 6 mm (such as 3 mm, 4 mm, or 5 mm). In some aspects, the outer diameter of the forging mandrel 230 includes a taper, such as 0.15 degrees or less, 0.01 degrees or less, or 0.05 degrees or less.

As illustrated, in some aspects, the forging mandrel 230 includes a channel 232 through which a coolant, such as water or air (such as compressed air), is flowed. In some aspects, the channel 232 may be omitted. In some aspects, the forging mandrel 230 may be hardened, such as to 52-54 HRC. In some aspects, an exterior of the forging mandrel 230 includes a coating 234, such as a ceramic. Exemplary coating 234 materials include metal carbides, such as tungsten carbide, and metal oxides, such as zirconium oxide or aluminum oxide. In some aspects, the coating 234 may include a metal carbide combined with a minor amount of another metal, such as cobalt or chromium In some aspects, the coating 234 resists adhering to the workpiece 100. In some aspects, such as aspects in which the coating 218 includes one or more ceramics such as zirconium oxide, the coating 234 has a thermal conductivity that is lower than a thermal conductivity of the material of the forging mandrel 230. In an example, the coating 234 plus the coolant serve to hinder the temperature rise experienced by the forging mandrel 230 resulting from insertion into the bore 118 of the workpiece 100. In such an example, the thermal expansion of the forging mandrel 230 may be so managed to avoid the forging mandrel 230 becoming stuck within the bore 118 of the workpiece 100. In some aspects, the coating 234 has a thermal conductivity that is higher than a thermal conductivity of the material of the forging mandrel 230. In some aspects, the coating 234 prevents metal-to-metal contact between the base metal of the forging mandrel 230 and the workpiece 100. In some aspects, the interface between the forging mandrel 230 and the bore 118 of the workpiece 100 is lubricated, such as by graphite, to aid subsequent removal of the forging mandrel 230 from the workpiece 100.

The clamp 210, the hammers 220, and the forging mandrel 230 may be considered as components of the radial forging machine 200. In some aspects, the radial forging machine 200 includes other components, such as a controller, sensors, actuators, etc.

During a radial forging operation, the workpiece 100 is heated, as described above, and then transferred to the radial forging machine 200. In some aspects, a lubricant, such as graphite, is applied to the exterior of the workpiece 100. In some aspects, the lubricant is applied to the bore 118 of the workpiece 100. In some aspects, the lubricant is applied to the exterior of the clamping mandrel 214. In some aspects, the lubricant is applied to the exterior of the forging mandrel 230. The clamp 210 holds the workpiece 100 at one end 114, 116 of the workpiece 100. In some aspects, the clamping mandrel 214 is inserted into the bore 118 of the workpiece 100. The clamp 210 is manipulated to insert the workpiece 100 between the hammers 220. The forging mandrel 230 is inserted into the bore 118 of the workpiece 100, and is advanced to a location between the hammers 220.

Radial forging involves activating the hammers 220 to repeatedly strike the workpiece 100. In some aspects, the hammers 220 are operated to strike the workpiece 100 at a frequency of from 10 to 30 times per second (such as from 15 to 25 times per second or at about 20 times per second). The hammers 220 strike the workpiece 100 simultaneously around the circumference of the workpiece 100. Radial forging of the workpiece 100 produces a localized displacement of material that results in a reduction of the outer diameter of at least a portion of the workpiece 100, a reduction of the inner diameter of at least a portion of the bore 118 of the workpiece 100, and a corresponding increase in the length of the workpiece 100.

During the forging, the clamp 210 moves the workpiece 100 axially between each successive strike of the hammers 220. In some aspects, the clamp 210 applies an axial compressive force on the workpiece 100 to push the workpiece 100 between each successive strike of the hammers 220 during the forging. However, as illustrated in the Figure, in some aspects, the clamp 210 applies an axial tensile force on the workpiece 100 to pull the workpiece 100 between each successive strike of the hammers 220 during the forging. In some aspects, the clamp 210 rotates the workpiece 100 about the longitudinal axis 112 between each successive strike of the hammers 220 during forging. In some aspects, the clamp 210 does not rotate the workpiece 100 about the longitudinal axis 112 during forging. In some aspects, the hammers 220 rotate about the longitudinal axis 112 of the workpiece 100 between each successive strike of the hammers 220 during forging. In some aspects, the hammers 220 do not rotate about the longitudinal axis 112 of the workpiece 100 during forging.

As illustrated, in some aspects, one or more stands 240 provide support to one or more sections of the workpiece 100. The one or more stands 240 may be positioned between the hammers 220 and the clamp 210 and/or on the side of the hammers 220 opposite to the clamp 210. The one or more stands 240 hinder sagging of a portion of the workpiece 100 (as the portion of the workpiece 100 cools while another portion of the workpiece 100 undergoes forging) that otherwise may result in the workpiece 100 becoming distorted. In some aspects, any one or more of the one or more stands 240 on either side of the hammers 220 may be omitted.

In some aspects, upon completion of the forging, the workpiece 100 may be held in place at the radial forging machine 200 by the clamp 210 and supported on the one or more stands 240 for a resting period. In some aspects, the clamp 210 rotates the workpiece 100 about the longitudinal axis 112 during the resting period. The forging mandrel 230 may be removed from the bore 118 of the workpiece 100 prior to, during, or after the resting period. In some aspects, the forging mandrel 230 may be axially moved (in a single direction or reciprocated) within the bore 118 of the workpiece 100 during the resting period. The resting period may last a preselected time and/or until the workpiece 100 cools to a preselected temperature. The resting period mitigates potential bending of a still-hot workpiece 100 during subsequent handling of the workpiece 100. As the workpiece 100 cools, the material of the workpiece 100 hardens and becomes increasingly resistant to bending during subsequent handling.

FIGS. 3A-3G are longitudinal cross-sections that schematically illustrate details of the radial forging of the workpiece 100 from the preform (110, FIG. 1A) to produce the intermediate component (120, FIG. 1B). In some aspects, the radial forging of the workpiece 100 to form the intermediate component 120 is performed in three radial forging operations. FIGS. 3A-3D schematically illustrate the forging process of the first radial forging operation. For clarity, items such as the clamp 210 and stands 240 are not shown, whereas the hammers 220 and forging mandrel 230 are depicted. Although not shown, the clamp 210 holds the workpiece 100 at the second end 116 during the forging process of the first radial forging operation. The workpiece 100 is shown depicting the first, second, and third regions 101, 102, 103, described above.

Figure 3A:
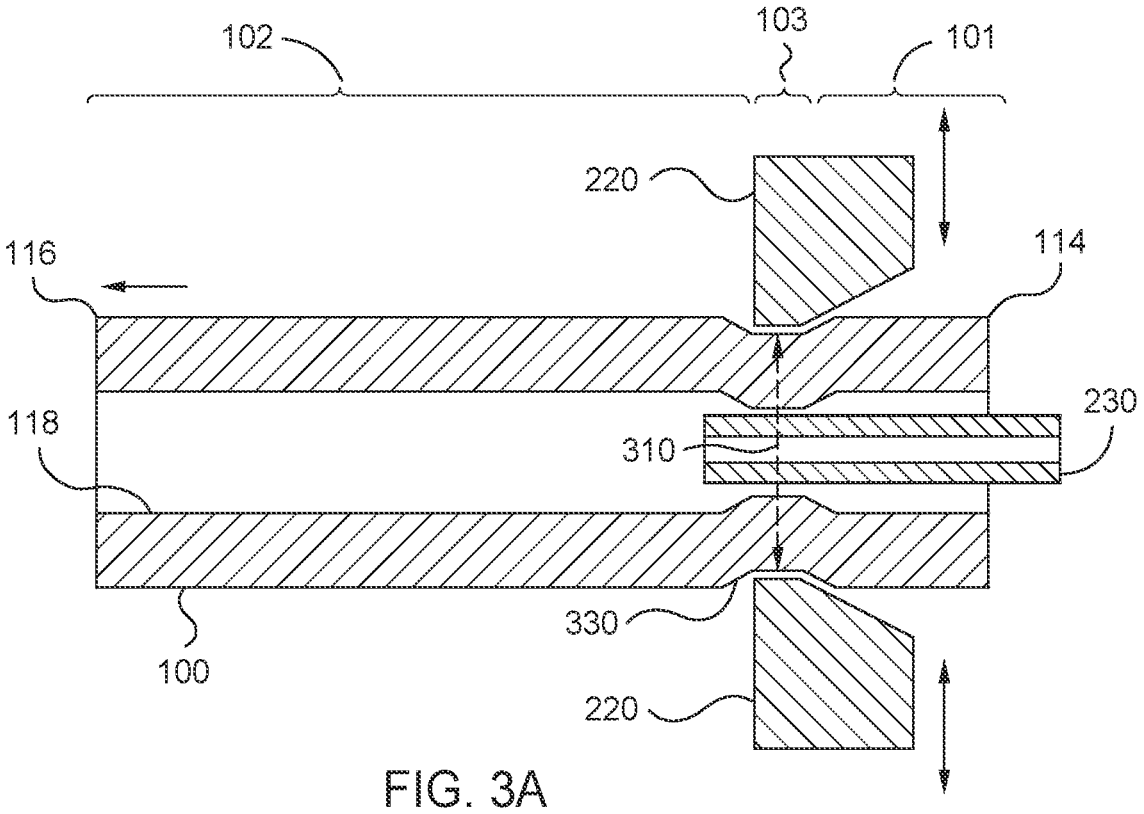
FIGS. 3A-3G are longitudinal cross-sections that schematically illustrate details of a radial forging operation.

In FIG. 3A, the hammers are forging the third region 103, which will become the flange 136 of the finished component 130 (FIG. 1C). The forging mandrel 230 is inserted into the bore 118 of the workpiece 100 and positioned between the hammers 220. The hammers 220 are activated, and the forging commences with plunge forging, in which the hammers 220 close together to an ever greater extent at each successive strike until the outer diameter of the workpiece 100 at the hammers 220 is reduced to a forging diameter 310. In some aspects, the clamp 210 rotates the workpiece 100 about the longitudinal axis 112 during forging. The clamp 210 pulls the workpiece 100 axially between the hammers 220. In an example, the clamp 210 moves the workpiece 100 axially at a rate that starts at 270 to 330 mm/min (such as at 280 to 320 mm/min, 290 to 310 mm/min, or about 300 mm/min) and is ramped down during plunge forging to reach 170 to 230 mm/min (such as at 180 to 220 mm/min, 190 to 210 mm/min, or about 200 mm/min) by the time at which the hammers 220 striking the workpiece 100 locally reduces the outer diameter of the workpiece 100 to the forging diameter 310. Also, the inner diameter of the bore 118 of the workpiece 100 is locally reduced. Axial movement of the workpiece 100 during plunge forging results in the formation of a tapered section 330.

In some aspects, the forging mandrel 230 is not moved axially with respect to the hammers 220 during the plunge forging. In some aspects, the forging mandrel 230 is moved axially with respect to the hammers 220 during the plunge forging. In some of such aspects, the forging mandrel 230 is moved axially in the same direction as the workpiece 100 is moved. Alternatively, or additionally, the forging mandrel 230 may be moved axially in the opposite direction to the direction in which the workpiece 100 is moved. In an example, the forging mandrel 230 is moved axially at a speed of 0.2-2.0 mm/s (such as at a speed of 0.3-1.5 mm/s, 0.4-1.0 mm/s, 0.5-0.8 mm/s, or about 0.6 mm/s).

Figure 3B:
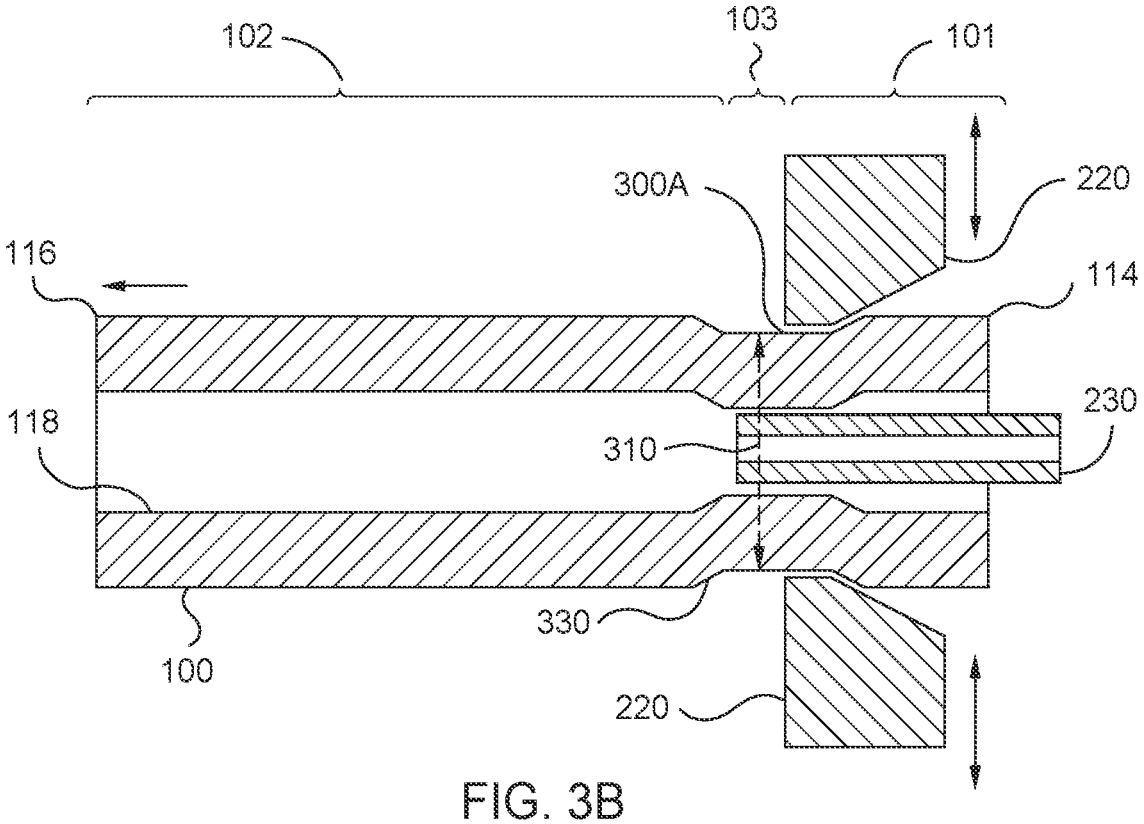

FIG. 3B illustrates a subsequent action of feed forging, in which the hammers 220 close together to form the forging diameter 310 (attained by the previous plunge forging) with each successive strike of the workpiece 100. In some aspects, the clamp 210 continues to rotate the workpiece 100 about the longitudinal axis 112 during forging. The clamp 210 continues to pull the workpiece 100 axially between the hammers 220. In an example, the clamp 210 moves the workpiece 100 axially at a rate of 1100 to 1300 mm/min (such as at 1150 to 1250 mm/min, 1175 to 1225 mm/min, or about 1200 mm/min) during feed forging.

In some aspects, the forging mandrel 230 is not moved axially with respect to the hammers 220 during the feed forging. In some aspects, the forging mandrel 230 is moved axially with respect to the hammers 220 during the feed forging. In some of such aspects, the forging mandrel 230 is moved axially in the same direction as the workpiece 100 is moved. Alternatively, or additionally, the forging mandrel 230 may be moved axially in the opposite direction to the direction in which the workpiece 100 is moved. In an example, the forging mandrel 230 is moved axially in any one or more of the above-stated directions at a speed of 0.5-4.0 mm/s (such as at a speed of 1.0-3.5 mm/s, 1.5-3.0 mm/s, 2.0-2.5 mm/s, or about 2.3 mm/s).

Forging continues into the first region 101 of the workpiece 100. During the first radial forging operation, the outer diameter of at least a portion of the first region 101 is further reduced to another forging diameter (312, FIG. 3C). When the location 300A of the workpiece 100 (corresponding to the interface between the first and third regions 101, 103) emerges from between the hammers 220, another plunge forging operation is commenced while the hammers 220 remain activated. In some aspects, the clamp 210 continues to rotate the workpiece 100 about the longitudinal axis 112 during forging. The clamp 210 continues to pull the workpiece 100 axially between the hammers 220. In an example, the clamp 210 moves the workpiece 100 axially at a rate that starts at 270 to 330 mm/min (such as at 280 to 320 mm/min, 290 to 310 mm/min, or about 300 mm/min) and is ramped down during plunge forging to reach 170 to 230 mm/min (such as at 180 to 220 mm/min, 190 to 210 mm/min, or about 200 mm/min) by the time at which the hammers 220 striking the workpiece 100 locally reduces the outer diameter of the workpiece 100 to the new forging diameter 312. Also, the inner diameter of the bore 118 of the workpiece 100 is locally reduced. Axial movement of the workpiece 100 during plunge forging results in the formation of another tapered section 332.

In some aspects, the forging mandrel 230 is not moved axially with respect to the hammers 220 during the plunge forging. In some aspects, the forging mandrel 230 is moved axially with respect to the hammers 220 during the plunge forging. In some of such aspects, the forging mandrel 230 is moved axially in the same direction as the workpiece 100 is moved. Alternatively, or additionally, the forging mandrel 230 may be moved axially in the opposite direction to the direction in which the workpiece 100 is moved. In an example, the forging mandrel 230 is moved axially at a speed of 0.2-2.0 mm/s (such as at a speed of 0.3-1.5 mm/s, 0.4-1.0 mm/s, 0.5-0.8 mm/s, or about 0.6 mm/s).

Figure 3C:
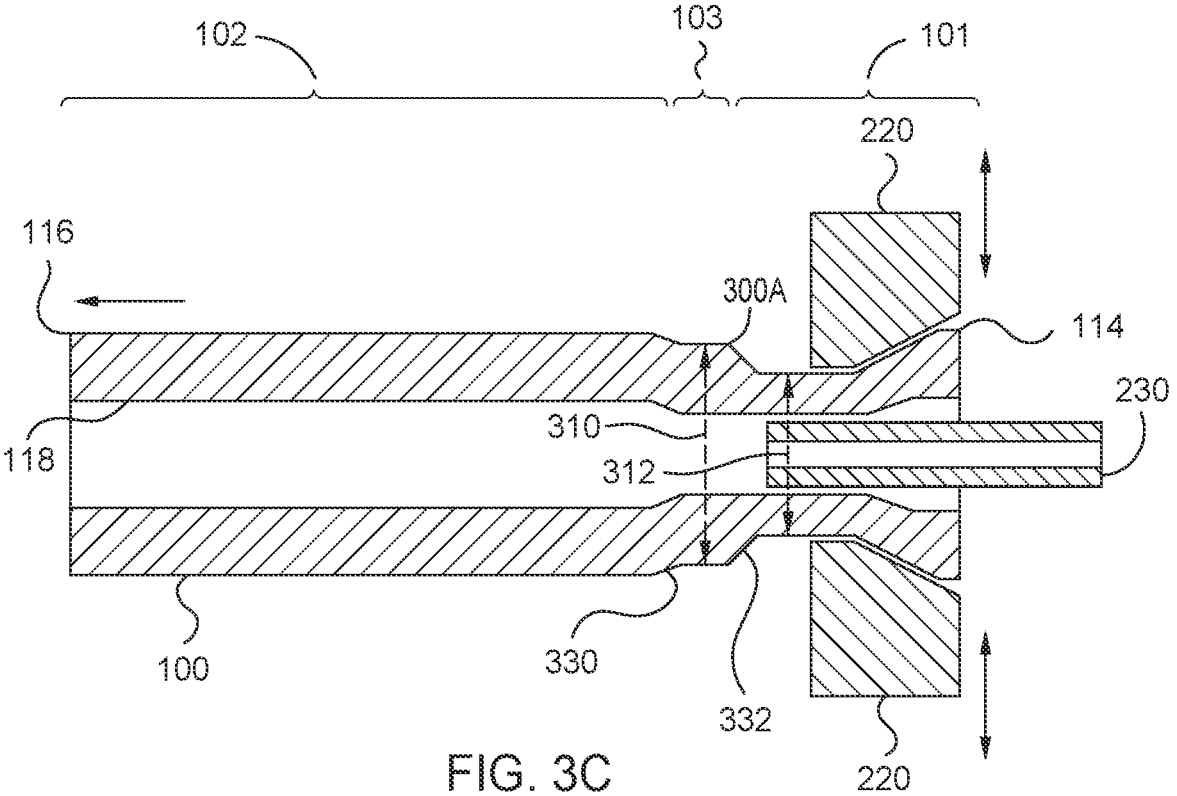

FIG. 3C illustrates a subsequent action of feed forging, in which the hammers 220 close together to form the forging diameter 312 (attained by the previous plunge forging) with each successive strike of the workpiece 100. In some aspects, the clamp 210 continues to rotate the workpiece 100 about the longitudinal axis 112 during forging. The clamp 210 continues to pull the workpiece 100 axially between the hammers 220. In an example, the clamp 210 moves the workpiece 100 axially at a rate of 1100 to 1300 mm/min (such as at 1150 to 1250 mm/min, 1175 to 1225 mm/min, or about 1200 mm/min) during feed forging.

In some aspects, the forging mandrel 230 is not moved axially with respect to the hammers 220 during the feed forging. In some aspects, the forging mandrel 230 is moved axially with respect to the hammers 220 during the feed forging. In some of such aspects, the forging mandrel 230 is moved axially in the same direction as the workpiece 100 is moved. Alternatively, or additionally, the forging mandrel 230 may be moved axially in the opposite direction to the direction in which the workpiece 100 is moved. In an example, the forging mandrel 230 is moved axially at a speed of 0.5-4.0 mm/s (such as at a speed of 1.0-3.5 mm/s, 1.5-3.0 mm/s, 2.0-2.5 mm/s, or about 2.3 mm/s).

Figure 3D:
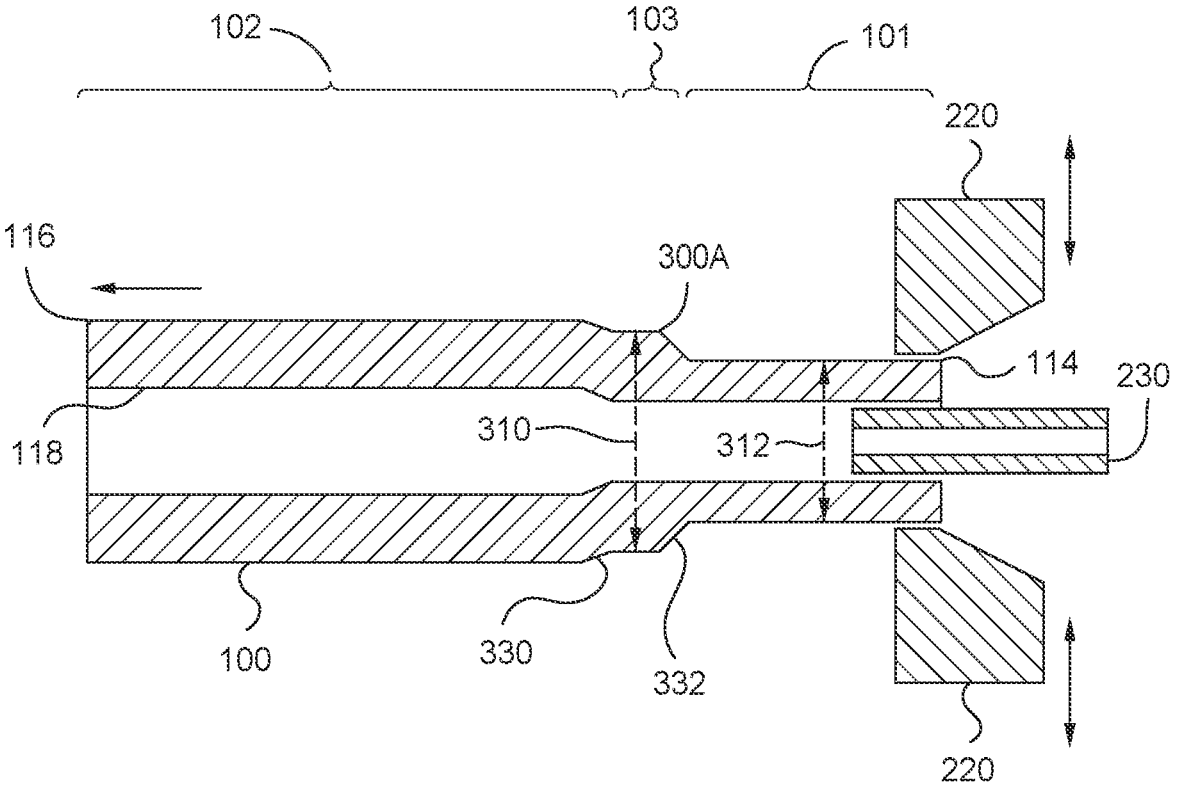

FIG. 3D illustrates the end of the feed forging action of FIG. 3C. The outer diameter of the remainder of the first region 101 from the tapered section 332 up to and including the first end 114 becomes reduced to the forging diameter 312. In some aspects, once the first end 114 has been forged to the forging diameter 312, the first radial forging operation concludes with holding the workpiece 100 in place at the radial forging machine 200 for a resting period, as described above. In some aspects, the workpiece 100 is supported on one or more stands 140 during any of the above forging actions and/or during the resting period.

Between the first radial forging operation and the second radial forging operation, the workpiece 100 is reheated. The reheating is conducted as described above. In some aspects, the workpiece 100 is reheated to the temperature to which the workpiece 100 had been heated prior to the first radial forging operation. In some aspects, the workpiece 100 is reheated to a different temperature than that to which the workpiece 100 had been heated prior to the first radial forging operation. In an example, in aspects in which the second radial forging operation is anticipated to take more time than the first radial forging operation, the workpiece 100 may be heated to a temperature greater than or equal to that to which the workpiece 100 had been heated prior to the first radial forging operation. In another example, in aspects in which the second radial forging operation is anticipated to take less time than the first radial forging operation, the workpiece 100 may be heated to a temperature less than or equal to that to which the workpiece 100 had been heated prior to the first radial forging operation.

Figure 3E:
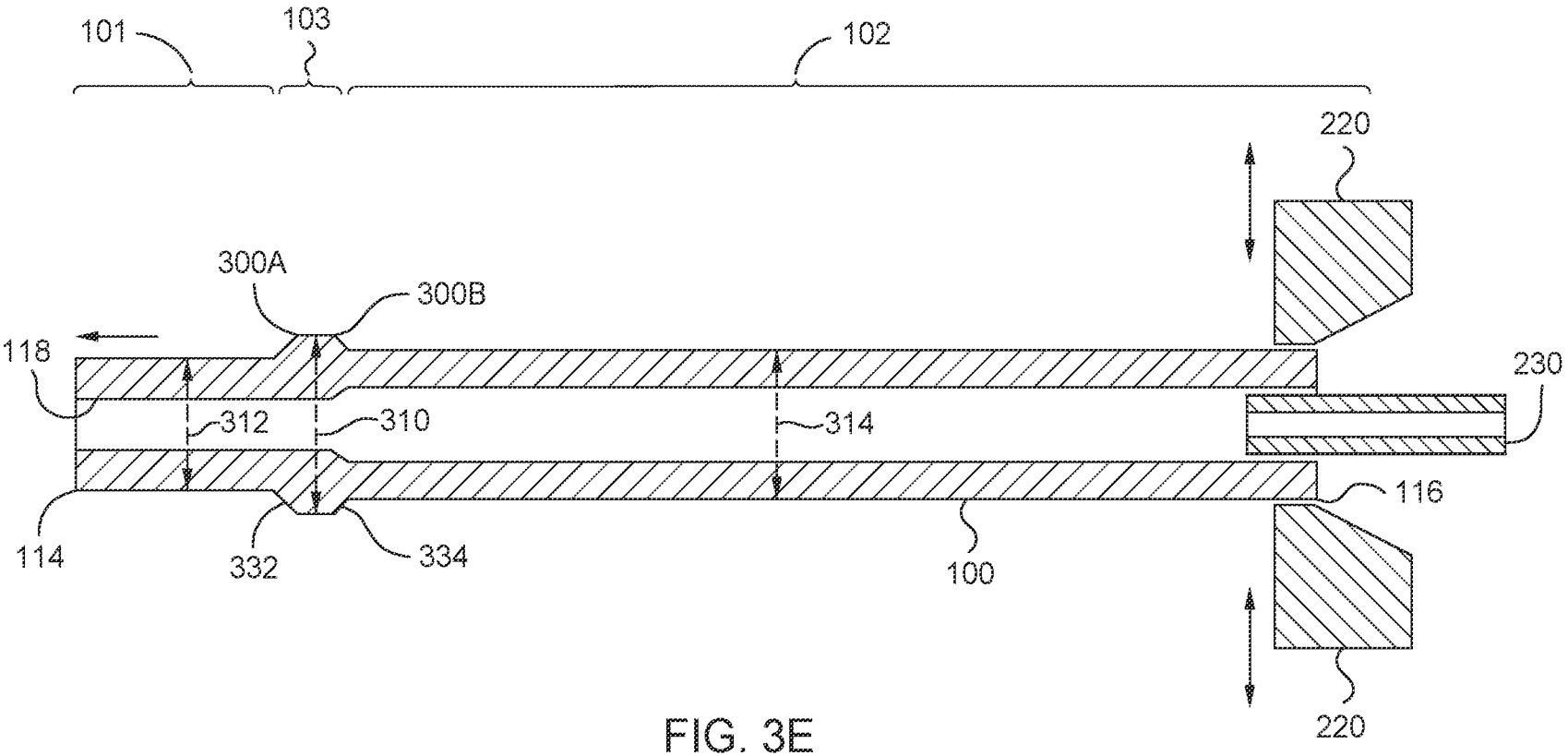

FIG. 3E illustrates the workpiece 100 at the conclusion of the second radial forging operation. For the second radial forging operation, the clamp 210 holds the workpiece 100 at the first end 114. In some aspects, the clamp 210 uses the clamping mandrel 214, as described above, to mitigate deformation of the first end by the clamp jaws 212. In the second radial forging operation, the outer diameter of at least a portion of the second region is reduced from the outer diameter of the preform (110, FIG. 1A) to another forging diameter 314.

At the location 300B of the workpiece 100 (corresponding to the transition between the second and third regions), a plunge forging operation is commenced, such as described above. In some aspects, the clamp 210 rotates the workpiece 100 about the longitudinal axis 112 during the plunge forging. The clamp 210 pulls the workpiece 100 axially between the hammers 220. In an example, the clamp 210 moves the workpiece 100 axially at a rate that starts at 270 to 330 mm/min (such as at 280 to 320 mm/min, 290 to 310 mm/min, or about 300 mm/min) and is ramped down during plunge forging to reach 170 to 230 mm/min (such as at 180 to 220 mm/min, 190 to 210 mm/min, or about 200 mm/min) by the time at which the hammers 220 striking the workpiece 100 locally reduces the outer diameter of the workpiece 100 to the forging diameter 314. Also, the inner diameter of the bore 118 of the workpiece 100 is locally reduced. Axial movement of the workpiece 100 during plunge forging results in the formation of another tapered section 334.

In some aspects, the forging mandrel 230 is not moved axially with respect to the hammers 220 during the plunge forging. In some aspects, the forging mandrel 230 is moved axially with respect to the hammers 220 during the plunge forging. In some of such aspects, the forging mandrel 230 is moved axially in the same direction as the workpiece 100 is moved. Alternatively, or additionally, the forging mandrel 230 may be moved axially in the opposite direction to the direction in which the workpiece 100 is moved. In an example, the forging mandrel 230 is moved axially at a speed of 0.2-2.0 mm/s (such as at a speed of 0.3-1.5 mm/s, 0.4-1.0 mm/s, 0.5-0.8 mm/s, or about 0.6 mm/s).

Once the hammers 220 striking the workpiece 100 forms the forging diameter 314, the forging action is transitioned from plunge forging to feed forging. In some aspects, the clamp 210 continues to rotate the workpiece 100 about the longitudinal axis 112 during feed forging. The clamp 210 continues to pull the workpiece 100 axially between the hammers 220 such that a remainder of the second region 102 of the workpiece 100 up to and including the second end 116 is forged to the forging diameter 314 attained by the previous plunge forging. In an example, the clamp 210 moves the workpiece 100 axially at a rate that starts at 800 to 1200 mm/min (such as at 900 to 1100 mm/min, 950 to 1050 mm/min, or about 1000 mm/min) and is ramped up during feed forging to reach 1300 to 1700 mm/min (such as at 1400 to 1600 mm/min, 1450 to 1550 mm/min, or about 1500 mm/min) by the time at which the second end 116 of the workpiece 100 is being forged.

In some aspects, the forging mandrel 230 is not moved axially with respect to the hammers 220 during the feed forging. In some aspects, the forging mandrel 230 is moved axially with respect to the hammers 220 during the feed forging. In some of such aspects, the forging mandrel 230 is moved axially in the same direction as the workpiece 100 is moved. Alternatively, or additionally, the forging mandrel 230 may be moved axially in the opposite direction to the direction in which the workpiece 100 is moved. In an example, the forging mandrel 230 is moved axially at a speed of 0.5-4.0 mm/s (such as at a speed of 1.0-3.5 mm/s, 1.5-3.0 mm/s, 2.0-2.5 mm/s, or about 2.3 mm/s).

In some aspects, once the second end 116 has been forged to the forging diameter 314, the second radial forging operation concludes with holding the workpiece 100 in place at the radial forging machine 200 for a resting period, as described above. In some aspects, the workpiece 100 is supported on one or more stands 140 during any of the above forging actions and/or during the resting period.

Between the second radial forging operation and the third radial forging operation, the workpiece 100 is reheated. The reheating is conducted as described above. In some aspects, the workpiece 100 is reheated to the temperature to which the workpiece 100 had been heated prior to the second radial forging operation. In some aspects, the workpiece 100 is reheated to a different temperature than that to which the workpiece 100 had been heated prior to the second radial forging operation. In an example, in aspects in which the third radial forging operation is anticipated to take more time than the second radial forging operation, the workpiece 100 may be heated to a temperature greater than or equal to that to which the workpiece 100 had been heated prior to the second radial forging operation. In another example, in aspects in which the third radial forging operation is anticipated to take less time than the second radial forging operation, the workpiece 100 may be heated to a temperature less than or equal to that to which the workpiece 100 had been heated prior to the second radial forging operation.

Figure 3F:
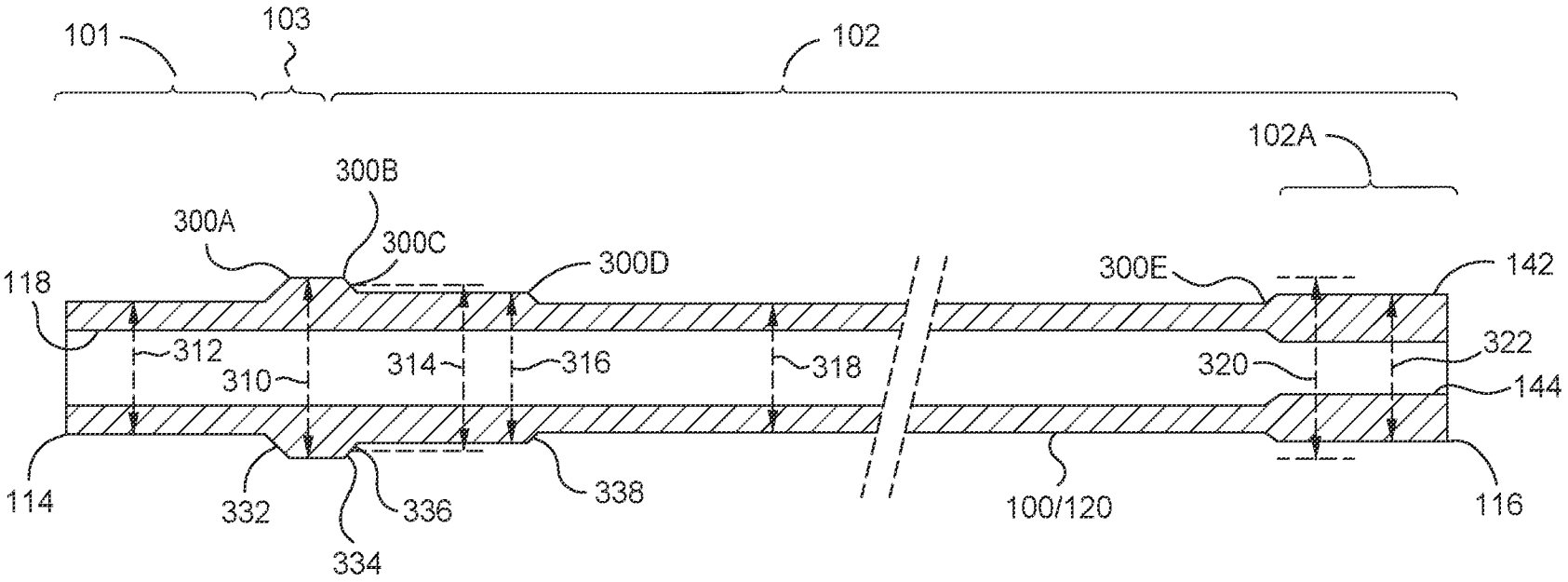

FIG. 3F illustrates the workpiece 100 at the conclusion of the third radial forging operation. For the third radial forging operation, the clamp 210 holds the workpiece 100 at the first end 114. In some aspects, the clamp 210 uses the clamping mandrel 214, as described above, to mitigate deformation of the first end by the clamp jaws 212. In the third radial forging operation, the outer diameter of at least a portion of the second region 102 is reduced from the outer diameter 314 attained during the second radial forging operation to a smaller forging diameter 316.

At the location 300C of the workpiece 100 (in the second region 102, and near to location 300B), a plunge forging operation is commenced, such as described above. In some aspects, the clamp 210 rotates the workpiece 100 about the longitudinal axis 112 during the plunge forging. The hammers 220 are activated, and the clamp 210 pulls the workpiece 100 axially between the hammers 220. In an example, the clamp 210 moves the workpiece 100 axially at a rate that starts at 170 to 230 mm/min (such as at 180 to 220 mm/min, 190 to 210 mm/min, or about 200 mm/min) and is ramped down during plunge forging to reach 140 to 200 mm/min (such as at 150 to 190 mm/min, 160 to 180 mm/min, or about 170 mm/min) by the time at which the hammers 220 striking the workpiece 100 locally reduces the outer diameter of the workpiece 100 to the new forging diameter 316. Also, the inner diameter of the bore 118 of the workpiece 100 is locally reduced. Axial movement of the workpiece 100 during plunge forging results in the formation of another tapered section 336. The tapered section 336 may be a continuation of the tapered section 334.

In some aspects, the forging mandrel 230 is not moved axially with respect to the hammers 220 during the plunge forging. In some aspects, the forging mandrel 230 is moved axially with respect to the hammers 220 during the plunge forging. In some of such aspects, the forging mandrel 230 is moved axially in the same direction as the workpiece 100 is moved. Alternatively, or additionally, the forging mandrel 230 may be moved axially in the opposite direction to the direction in which the workpiece 100 is moved. In an example, the forging mandrel 230 is moved axially at a speed of 0.2-2.0 mm/s (such as at a speed of 0.3-1.5 mm/s, 0.4-1.0 mm/s, 0.5-0.8 mm/s, or about 0.6 mm/s).

Once the hammers 220 striking the workpiece 100 forms the forging diameter 316, the forging action is transitioned from plunge forging to feed forging. In some aspects, the clamp 210 continues to rotate the workpiece 100 about the longitudinal axis 112 during feed forging. The clamp 210 continues to pull the workpiece 100 axially between the hammers 220 such that at least a portion of the second region 102 of the workpiece 100 is forged to the forging diameter 316 attained by the previous plunge forging. In an example, the clamp 210 moves the workpiece 100 axially at a rate of 1700 to 1900 mm/min (such as at 1750 to 1850 mm/min, 1775 to 1825 mm/min, or about 1800 mm/min) during feed forging.

In some aspects, the forging mandrel 230 is not moved axially with respect to the hammers 220 during the feed forging. In some aspects, the forging mandrel 230 is moved axially with respect to the hammers 220 during the feed forging. In some of such aspects, the forging mandrel 230 is moved axially in the same direction as the workpiece 100 is moved. Alternatively, or additionally, the forging mandrel 230 may be moved axially in the opposite direction to the direction in which the workpiece 100 is moved. In an example, the forging mandrel 230 is moved axially at a speed of 0.5-4.0 mm/s (such as at a speed of 1.0-3.5 mm/s, 1.5-3.0 mm/s, 2.0-2.5 mm/s, or about 2.3 mm/s).

During the third radial forging operation, the outer diameter of at least a portion of the second region 102 is further reduced to another forging diameter 318. When the location 300D of the workpiece 100 emerges from between the hammers 220, another plunge forging operation is commenced while the hammers 220 remain activated. In some aspects, the clamp 210 continues to rotate the workpiece 100 about the longitudinal axis 112 during the plunge forging. The clamp 210 continues to pull the workpiece 100 axially between the hammers 220. In an example, the clamp 210 moves the workpiece 100 axially at a rate that starts at 170 to 230 mm/min (such as at 180 to 220 mm/min, 190 to 210 mm/min, or about 200 mm/min) and is ramped down during plunge forging to reach 140 to 200 mm/min (such as at 150 to 190 mm/min, 160 to 180 mm/min, or about 170 mm/min) by the time at which the hammers 220 striking the workpiece 100 locally reduces the outer diameter of the workpiece 100 to the new forging diameter 318. Also, the inner diameter of the bore 118 of the workpiece 100 is locally reduced. Axial movement of the workpiece 100 during plunge forging results in the formation of another tapered section 338.

In some aspects, the forging mandrel 230 is not moved axially with respect to the hammers 220 during the plunge forging. In some aspects, the forging mandrel 230 is moved axially with respect to the hammers 220 during the plunge forging. In some of such aspects, the forging mandrel 230 is moved axially in the same direction as the workpiece 100 is moved. Alternatively, or additionally, the forging mandrel 230 may be moved axially in the opposite direction to the direction in which the workpiece 100 is moved. In an example, the forging mandrel 230 is moved axially at a speed of 0.2-2.0 mm/s (such as at a speed of 0.3-1.5 mm/s, 0.4-1.0 mm/s, 0.5-0.8 mm/s, or about 0.6 mm/s).

Once the hammers 220 striking the workpiece 100 forms the forging diameter 318, the forging action is transitioned from plunge forging to feed forging. In some aspects, the clamp 210 continues to rotate the workpiece 100 about the longitudinal axis 112 during the feed forging. The clamp 210 continues to pull the workpiece 100 axially between the hammers 220 such that at least a portion of the second region 102 of the workpiece 100 is forged to the forging diameter 318 attained by the previous plunge forging. In an example, the clamp 210 moves the workpiece 100 axially at a rate of 1700 to 1900 mm/min (such as at 1750 to 1850 mm/min, 1775 to 1825 mm/min, or about 1800 mm/min) during feed forging.

In some aspects, the forging mandrel 230 is not moved axially with respect to the hammers 220 during the feed forging. In some aspects, the forging mandrel 230 is moved axially with respect to the hammers 220 during the feed forging. In some of such aspects, the forging mandrel 230 is moved axially in the same direction as the workpiece 100 is moved. Alternatively, or additionally, the forging mandrel 230 may be moved axially in the opposite direction to the direction in which the workpiece 100 is moved. In an example, the forging mandrel 230 is moved axially at a speed of 0.5-4.0 mm/s (such as at a speed of 1.0-3.5 mm/s, 1.5-3.0 mm/s, 2.0-2.5 mm/s, or about 2.3 mm/s).

In a section 102A of the second region 102 of the workpiece 100 proximal to, and including, the second end 116, the third radial forging operation creates an external upset 142 and an internal upset 144. The external and internal upsets 142, 144 are created by two passes of the section 102A between the hammers 220 during the third radial forging operation.

Figure 3G:
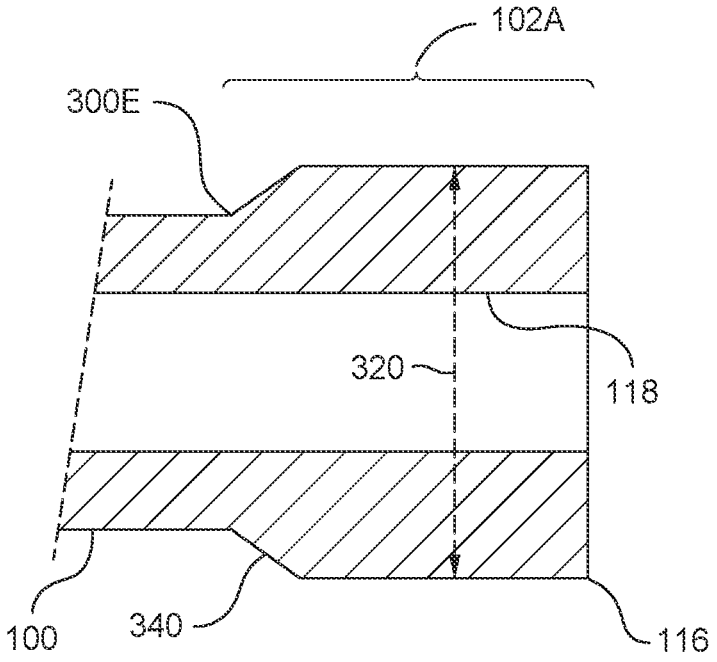

FIG. 3G is an enlarged view of section 102A illustrating the workpiece 100 at the conclusion of the first pass of the third radial forging operation. The first pass is initiated when the location 300E of the workpiece 100 (corresponding to the start of section 102A) emerges from between the hammers 220 during the preceding feed forging. In some aspects, the clamp 210 continues to rotate the workpiece 100 about the longitudinal axis 112 while the operation of the hammers 220 is adjusted such that the hammers 220 close together at a new forging diameter 320 that is greater than the preceding forging diameter 318. In some aspects, the clamp 210 continues to pull the workpiece 100 axially between the hammers 220 while the operation of the hammers 220 is adjusted such that the hammers 220 close together to a lesser extent than the preceding forging diameter 318. In some aspects, operation of the hammers 220 and the rotation and pulling actions of the clamp 210 are momentarily ceased to perform adjustments to the radial forging machine 200 such that the hammers 220 would close together to a lesser extent than the preceding forging diameter 318. In such aspects, upon restarting the forging operation of the hammers 220, the clamp 210 restarts rotation of the workpiece 100, and pulls the workpiece 100 axially at a rate similar to the rate applied during the earlier plunge forging. In any of the above aspects, the outer diameter of the workpiece 100 in section 102A is locally reduced from the diameter 314 (resulting from the second radial forging operation) to the forging diameter 320. Also, the inner diameter of the bore 118 of the workpiece 100 is locally reduced. In any of the above aspects, the transition to forging at the forging diameter 320 results in the formation of another tapered section 340.

In some aspects, the forging mandrel 230 is not moved axially with respect to the hammers 220 during the transition to forging at the forging diameter 320. In some aspects, the forging mandrel 230 is moved axially with respect to the hammers 220 during the transition to forging at the forging diameter 320. In some of such aspects, the forging mandrel 230 is moved axially in the same direction as the workpiece 100 is moved. Alternatively, or additionally, the forging mandrel 230 may be moved axially in the opposite direction to the direction in which the workpiece 100 is moved. In an example, the forging mandrel 230 is moved axially at a speed of 0.2-2.0 mm/s (such as at a speed of 0.3-1.5 mm/s, 0.4-1.0 mm/s, 0.5-0.8 mm/s, or about 0.6 mm/s).

Once the hammers 220 striking the workpiece 100 forms the forging diameter 320, the forging action is transitioned to feed forging. In some aspects, the clamp 210 continues to rotate the workpiece 100 about the longitudinal axis 112 during the feed forging. The clamp 210 continues to pull the workpiece 100 axially between the hammers 220 such that at least a portion of the section 102A of the second region 102 of the workpiece 100 is forged to the forging diameter 320. In an example, the clamp 210 moves the workpiece 100 axially at a rate of 1700 to 1900 mm/min (such as at 1750 to 1850 mm/min, 1775 to 1825 mm/min, or about 1800 mm/min) during feed forging.

In some aspects, the forging mandrel 230 is not moved axially with respect to the hammers 220 during the feed forging. In some aspects, the forging mandrel 230 is moved axially with respect to the hammers 220 during the feed forging. In some of such aspects, the forging mandrel 230 is moved axially in the same direction as the workpiece 100 is moved. Alternatively, or additionally, the forging mandrel 230 may be moved axially in the opposite direction to the direction in which the workpiece 100 is moved. In an example, the forging mandrel 230 is moved axially at a speed of 0.5-4.0 mm/s (such as at a speed of 1.0-3.5 mm/s, 1.5-3.0 mm/s, 2.0-2.5 mm/s, or about 2.3 mm/s).

The first pass concludes once the second end 116 of the workpiece 100 has been forged to the forging diameter 320. The hammers 220 are deactivated. The workpiece 100 is not removed from the radial forging machine 200 between the two passes. The clamp 210 moves the workpiece 100 axially such that the start of the section 102A (such as the location 300E) is located between, or proximal to, the hammers 220. Operation of the hammers 220 is adjusted such that the hammers 220 close together at a forging diameter 322 that is less than the preceding forging diameter 320.

The second pass commences with the hammers 220 being reactivated, and the clamp 210 pulling the workpiece 100 axially between the hammers 220. In some aspects, the clamp 210 rotates the workpiece 100 about the longitudinal axis 112 during the second pass. In some aspects, the second pass is conducted without the forging mandrel 230 present in the bore 118 of the workpiece 100 between the hammers 220. In some aspects, the second pass is conducted with a forging mandrel 230 having a smaller outer diameter than the previous forging mandrel 230 present in the bore 118 of the workpiece 100 between the hammers 220. In some aspects, the second pass commences with plunge forging, then continues along the section 102A with feed forging. In other aspects, the second pass involves radially forging section 102A by feed forging without initially plunge forging. The outer diameter of the workpiece 100 in section 102A, including the second end 116, is locally reduced to the forging diameter 322, producing the external upset 142. Also, the inner diameter of the bore 118 of the workpiece 100 is locally reduced, producing the internal upset 144.

In some aspects, once the second pass is completed, the third radial forging operation concludes with holding the workpiece 100 (now in the form of the intermediate component 120) in place at the radial forging machine 200 for a resting period, as described above. In some aspects, the workpiece 100 is supported on one or more stands 140 during any of the above forging actions and/or during the resting period.

In some aspects, the radial forging of the third region 103 of the workpiece 100 is performed during the second radial forging operation instead of during the first radial forging operation. In an example, the second radial forging operation commences by radially forging the third region 103 of the workpiece 100. In some aspects, the radial forging of the third region 103 of the workpiece 100 is performed during the third radial forging operation instead of during the first radial forging operation. In an example, the third radial forging operation commences by radially forging the third region 103 of the workpiece 100. In some aspects, the third region 103 of the workpiece 100 is not radially forged in any of the first, second, or third radial forging operations.

In some aspects, the second and third radial forging operations may be combined. In an example, the second radial forging operation is performed, but does not include the resting period at the conclusion of forging. The workpiece 100 is not removed from the radial forging machine 200. Instead, the clamp 210 moves the workpiece 100 back between the hammers 220 to position the location 300C at the hammers 220, and then the third radial forging operation is initiated.

In some aspects, the second radial forging operation may be omitted, such that the third radial forging operation is the next forging operation after the first radial forging operation (and any intermediate reheating of the workpiece 100). In an example, after the first radial forging operation (and any intermediate reheating of the workpiece 100), the workpiece 100 is positioned such that the location 300B is at the hammers 220, and then the actions of the third radial forging operation are performed.

In some aspects, after the third radial forging operation (such as after the resting period), the workpiece 100 (now in the form of the intermediate component 120) is hung vertically for further cooling. In some aspects, a post-forging operation is performed on the intermediate component 120 before the intermediate component 120 is further processed to become the finished component 130. In some aspects, the post-forging operation includes stress relieving. In some aspects, the post-forging operation includes straightening. Exemplary straightening operations include hot straightening (such as at a temperature above 300° C.), warm straightening (such as at an elevated temperature up to 300° C.), or cold straightening (such as at—or near—ambient temperature).

Figure 4:
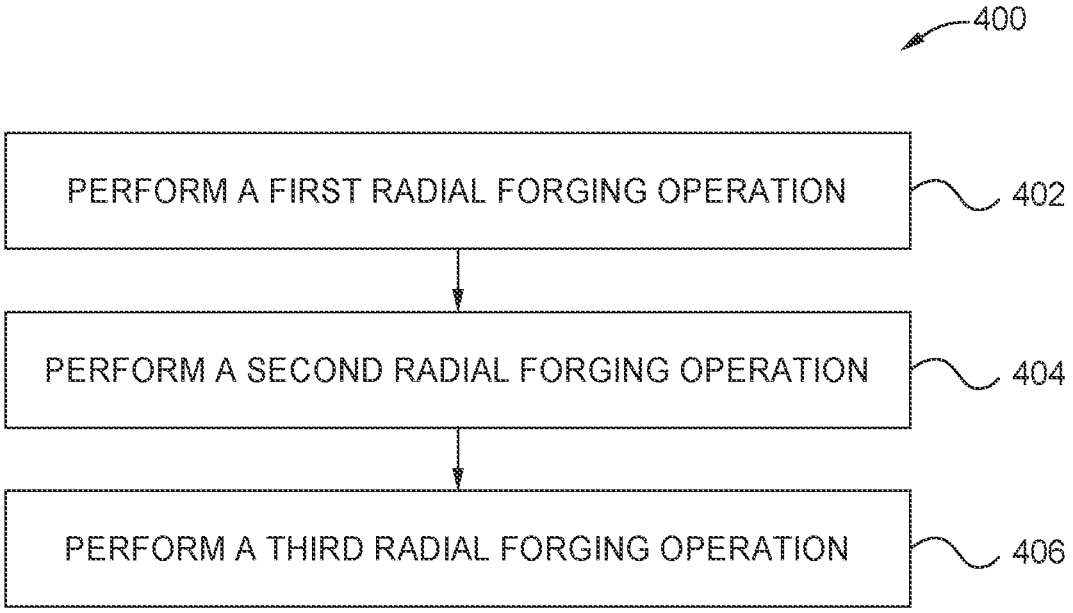
FIG. 4 is a flowchart of a method of manufacturing a tubular component.

FIG. 4 is a flowchart of a method 400 of manufacturing a tubular component, such as the intermediate component 120 described above. It is contemplated that the method may include any one or more of the aspects described herein. At operation 402, the method 400 includes performing a first radial forging operation on a workpiece, such as the workpiece 100. In some aspects, the workpiece includes a bore along a longitudinal axis extending from a first end to a second end opposite the first end. In some aspects, the first radial forging operation includes inserting a first mandrel (such as the forging mandrel 230) into the bore; holding the workpiece at the second end; and radially forging at least a portion of a first region proximal to the first end of the workpiece from a first outer diameter to a smaller second outer diameter. In some aspects, the first radial forging operation includes any one or more aspect described above with respect to FIGS. 2 and 3A-3D.

At operation 404, the method 400 includes performing a second radial forging operation on the workpiece. In some aspects, the second radial forging operation includes inserting a second mandrel (such as the forging mandrel 230) into the bore; holding the workpiece at the first end; and radially forging at least a first portion of a second region of the workpiece from the first outer diameter to a smaller third outer diameter, the second region extending from the second end to a third region adjoining the first region. In some aspects, the second radial forging operation includes any one or more aspect described above with respect to FIGS. 2 and 3E.

At operation 406, the method 400 includes performing a third radial forging operation on the workpiece. In some aspects, the third radial forging operation includes inserting a third mandrel (such as the forging mandrel 230) into the bore; holding the workpiece at the first end; and radially forging at least a second portion of the second region of the workpiece from the third outer diameter to a smaller fourth outer diameter. In some aspects, the second radial forging operation includes any one or more aspect described above with respect to FIGS. 2 and 3F-G.

In some aspects, the first mandrel is different from the second mandrel. In some aspects, the first mandrel is different from the third mandrel. In some aspects, the second mandrel is different from the third mandrel. In some aspects, the method 400 includes heating the workpiece prior to operation 402. In some aspects, the method 400 includes heating the workpiece between operation 402 and operation 404. In some aspects, the method 400 includes heating the workpiece between operation 404 and operation 406.

In some aspects, the method 400 includes performing a cold straightening operation on the tubular component after operation 406. In some aspects, the method 400 includes performing a machining operation on the tubular component after operation 406. In some aspects, the method 400 includes performing a cold straightening operation on the tubular component after operation 406 and then performing a machining operation on the tubular component.

Aspects of the present disclosure provide methods for manufacturing tubular components having complex geometries, while mitigating the waste of material that would be incurred in other manufacturing methods. In some aspects, the combined operations to produce a finished component, including the forging, heating, reheating, resting, cooling, post-forging treatments, and subsequent machining involve more operational stages than a more conventional manufacturing process in which the predominant operation is the machining of the finished component from bar stock material. Nevertheless, the incorporation of the forging operations disclosed herein into the manufacture of tubular components having complex geometries can realize efficiencies of time, material usage, and cost, particularly in the batch manufacture of large numbers of components, such as twenty or more. In some aspects, the forged components are defect-free or substantially defect-free. In some aspects, a defect at or near a surface of a forged component is removed by a post-forging treatment, such as machining. Notwithstanding potential defects, forging may beneficially form the components with a fine-grained structure. Such a fine-grained structure is in contrast to the relatively coarse grain structure of bar stock. Thus, components manufactured by incorporation of the forging operations disclosed herein can exhibit more desirable mechanical properties than similar components manufactured predominantly by machining without forging.

In the current disclosure, reference is made to various aspects. However, it should be understood that the present disclosure is not limited to specific described aspects. Instead, any combination of the following features and elements, whether related to different aspects or not, is contemplated to implement and practice the teachings provided herein. Additionally, when elements of the aspects are described in the form of "at least one of A and B," it will be understood that aspects including element A exclusively, including element B exclusively, and including element A and B are each contemplated. Furthermore, although some aspects may achieve advantages over other possible solutions and/or over the prior art, whether or not a particular advantage is achieved by a given aspect is not limiting of the present disclosure. Thus, the aspects, features, aspects and advantages disclosed herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As will be appreciated by one skilled in the art, aspects described herein may be embodied as a system, method or computer program product. Accordingly, aspects may take the form of an entirely hardware aspect, an entirely software aspect (including firmware, resident software, micro-code, etc.) or an aspect combining software and hardware aspects that may all generally be referred to herein as a "circuit," "module" or "system." Furthermore, aspects described herein may take the form of a computer program product embodied in one or more computer readable storage medium (s) having computer readable program code embodied thereon.

Program code embodied on a computer readable storage medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described herein with reference to flowchart illustrations and/or block diagrams of methods, apparatuses (systems), and computer program products according to aspects of the present disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the block(s) of the flowchart illustrations and/or block diagrams.

These computer program instructions may also be stored in a computer readable medium that can direct a computer, other programmable data processing apparatus, or other device to function in a particular manner, such that the instructions stored in the computer readable medium produce an article of manufacture including instructions which implement the function/act specified in the block(s) of the flowchart illustrations and/or block diagrams.

The computer program instructions may also be loaded onto a computer, other programmable data processing apparatus, or other device to cause a series of operational steps to be performed on the computer, other programmable apparatus or other device to produce a computer implemented process such that the instructions which execute on the computer, other programmable data processing apparatus, or other device provide processes for implementing the functions/acts specified in the block(s) of the flowchart illustrations and/or block diagrams.

The flowchart illustrations and block diagrams in the Figures illustrate the architecture, functionality, and operation of possible implementations of systems, methods, and computer program products according to various aspects of the present disclosure. In this regard, each block in the flowchart illustrations or block diagrams may represent a module, segment, or portion of code, which comprises one or more executable instructions for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order or out of order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

It is contemplated that elements and features of any one aspect may be beneficially incorporated in other aspects. While the foregoing is directed to aspects of the present disclosure, other and further aspects of the disclosure may be devised without departing from the basic scope thereof, and the scope thereof is determined by the claims that follow.

What is claimed is:

1. A method of manufacturing a tubular component, comprising:

performing a first radial forging operation on a workpiece, the workpiece including a bore along a longitudinal axis extending from a first end to a second end opposite the first end, the first radial forging operation comprising:

holding the workpiece at the second end; and radially forging at least a portion of a first region proximal to the first end of the workpiece from a first outer diameter to a smaller second outer diameter;

performing a second radial forging operation on the workpiece, the second radial forging operation comprising:

holding the workpiece at the first end; and radially forging at least a first portion of a second region of the workpiece from the first outer diameter to a smaller third outer diameter, the second region extending from the second end to a third region adjoining the first region; and performing a third radial forging operation on the workpiece, the third radial forging operation comprising:

holding the workpiece at the first end; and radially forging at least a second portion of the second region of the workpiece from the third outer diameter to a smaller fourth outer diameter.

2. The method of claim 1, further comprising heating the workpiece before commencing the first radial forging operation.

3. The method of claim 2, further comprising reheating the workpiece between the first radial forging operation and the second radial forging operation.

4. The method of claim 3, further comprising reheating the workpiece between the second radial forging operation and the third radial forging operation.

5. The method of claim 1, further comprising radially forging the third region from the first outer diameter to a smaller fifth outer diameter during the first radial forging operation.

6. The method of claim 5, wherein the fifth outer diameter is greater than the second outer diameter.

7. The method of claim 5, wherein the third radial forging operation further comprises radially forging at least a third portion of the second region of the workpiece from the third outer diameter to a smaller sixth outer diameter, the sixth outer diameter smaller than the fourth outer diameter.

8. The method of claim 1, wherein:

each of the first, second, and third radial forging operations are performed at a radial forging machine; and the workpiece is held at the radial forging machine to cool for a resting period at a conclusion of each of the first, second, and third radial forging operations.

9. The method of claim 8, further comprising:

removing the workpiece from the radial forging machine after the third radial forging operation; and then hanging the workpiece vertically while the workpiece cools further.

10. The method of claim 9, further comprising performing a straightening operation on the workpiece after the workpiece cools further.

11. The method of claim 10, further comprising machining the workpiece after performing the straightening operation, the machining operation including machining the third region to form a flange.

12. A method of manufacturing a tubular component, comprising:

performing a first radial forging operation on a workpiece, the workpiece including a bore along a longitudinal axis extending from a first end to a second end opposite the first end, the first radial forging operation comprising:

holding the workpiece at the second end; and radially forging at least a portion of a first region proximal to the first end of the workpiece from a first outer diameter to a smaller second outer diameter; and performing a second radial forging operation on the workpiece, the second radial forging operation comprising:

holding the workpiece at the first end; and radially forging at least a first portion of a second region of the workpiece from the first outer diameter to a smaller third outer diameter, the second region extending from the second end to a third region adjoining the first region.

13. The method of claim 12, further comprising heating the workpiece before commencing the first radial forging operation.

14. The method of claim 13, further comprising reheating the workpiece between the first radial forging operation and the second radial forging operation.

15. The method of claim 12, further comprising radially forging the third region from the first outer diameter to a smaller fourth outer diameter.

16. The method of claim 15, wherein the fourth outer diameter is greater than the second outer diameter.

17. The method of claim 12, wherein the first radial forging operation is performed at a radial forging machine.

18. The method of claim 17, wherein the workpiece is held at the radial forging machine to cool for a resting period at a conclusion of the first radial forging operation.

19. The method of claim 12, wherein the second radial forging operation is performed at a radial forging machine.

20. The method of claim 19, wherein the workpiece is held at the radial forging machine to cool for a resting period at a conclusion of the first radial forging operation.

* * * * *